US009188361B2

(12) United States Patent
Yuan et al.

(10) Patent No.: US 9,188,361 B2
(45) Date of Patent: Nov. 17, 2015

(54) VENTILATING FAN FOR HEATING

(75) Inventors: Hongjian Yuan, Guangdong (CN); Guangmin Zeng, Guangdong (CN); Liang Tian, Guangdong (CN); Makoto Ishikawa, Aichi (JP)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 54 days.

(21) Appl. No.: 14/005,974

(22) PCT Filed: Jun. 18, 2012

(86) PCT No.: PCT/CN2012/077076

§ 371 (c)(1),
(2), (4) Date: May 21, 2014

(87) PCT Pub. No.: WO2013/000365

PCT Pub. Date: Jan. 3, 2013

(65) Prior Publication Data

US 2014/0248041 A1 Sep. 4, 2014

(30) Foreign Application Priority Data

Jun. 30, 2011 (CN) ..... 2011 1 0181292

(51) Int. Cl.

| | |
|---|---|
| ***F24H 3/02*** | (2006.01) |
| ***F24H 3/04*** | (2006.01) |
| ***F04D 25/08*** | (2006.01) |
| ***F04D 29/58*** | (2006.01) |
| ***F04D 29/42*** | (2006.01) |

(52) U.S. Cl.

CPC ..... *F24H 3/0411* (2013.01); *F04D 25/08* (2013.01); *F04D 29/4226* (2013.01); *F04D 29/584* (2013.01)

(58) Field of Classification Search

None

See application file for complete search history.

(56) References Cited

U.S. PATENT DOCUMENTS

| | | | | | |
|---|---|---|---|---|---|
| 2,689,906 | A | * | 9/1954 | Corbett | 392/347 |
| 2,697,163 | A | * | 12/1954 | Spear | 392/364 |
| 2,870,319 | A | * | 1/1959 | Ford | 392/347 |
| 2,875,316 | A | * | 2/1959 | Ford et al. | 219/473 |
| 3,001,056 | A | * | 9/1961 | Spear | 392/347 |
| 3,028,475 | A | * | 4/1962 | Nash | 219/201 |
| 3,068,341 | A | * | 12/1962 | Ortiz et al. | 219/220 |
| 3,309,502 | A | * | 3/1967 | Witherspoon, Jr. | 392/364 |
| 3,320,406 | A | * | 5/1967 | Wainwright | 392/364 |

(Continued)

FOREIGN PATENT DOCUMENTS

| | | |
|---|---|---|
| CN | 101014273 | 8/2007 |
| CN | 101014273 A | 8/2007 |

(Continued)

OTHER PUBLICATIONS

International Search Report for International Appln. No. PCT/CN2012/077076, dated Sep. 20, 2012.

(Continued)

*Primary Examiner* — Thor Campbell
(74) *Attorney, Agent, or Firm* — RatnerPrestia

(57) ABSTRACT

A ventilating fan for heating, includes a main body frame provided with an opening, a fan casing provided with a fan therein, a heater assembly fixed at an air outlet of the fan casing and a thermostat for detecting an indoor temperature, and the thermostat is embedded in an air-passageway wall.

6 Claims, 6 Drawing Sheets

(56) References Cited

U.S. PATENT DOCUMENTS

| | | | | | |
|---|---|---|---|---|---|
| 3,909,589 | A | * | 9/1975 | Stone et al. | 392/347 |
| 4,681,024 | A | * | 7/1987 | Ivey | 454/233 |
| 5,207,505 | A | * | 5/1993 | Naraki et al. | 362/373 |
| 5,381,509 | A | * | 1/1995 | Mills | 392/376 |
| 5,619,612 | A | * | 4/1997 | Glucksman et al. | 392/360 |
| 8,961,126 | B1 | * | 2/2015 | Tom | 415/213.1 |

FOREIGN PATENT DOCUMENTS

| | | | |
|---|---|---|---|
| CN | 201289155 | | 8/2009 |
| CN | 201289155 | Y | 8/2009 |
| CN | 101545496 | | 9/2009 |
| CN | 101545496 | A | 9/2009 |
| JP | 7-190492 | | 7/1995 |
| JP | 7-190492 | A | 7/1995 |
| JP | 9-264576 | | 10/1997 |
| JP | 2005-315446 | | 11/2005 |

OTHER PUBLICATIONS

Written Opinion for International Appln. No. PCT/Cn2012/077076, dated Sep. 7, 2012.

Office Action issued in related Taiwanese Application No. 101122372, dated Mar. 4, 2015.

* cited by examiner

VENTILATING FAN FOR HEATING

FIELD OF THE INVENTION

The present disclosure relates to a ventilating fan, and in particular, to a ventilating fan for heating.

DESCRIPTION OF THE RELATED ART

FIGS. 1A and 1B show a conventional ventilating fan for heating 10 which is a ventilating fan to be embedded into a ceiling in use. The ventilating fan for heating 10 comprises a main body frame 11 provided with an opening 12, a fan casing 14 provided with a fan motor 13 therein, a heater assembly 15 fixed at an air outlet of the fan casing 14, and a thermostat 16 configured to monitor an indoor temperature and disposed under or above a heater. The ventilating fan to be embedded into a ceiling in use communicates with the indoor environment and the outdoor environment through conduits so as to realize functions such as ventilation and heating.

In the above ventilating fan to be embedded in a ceiling in use in the prior art, since the thermostat 16 of the ventilating fan is usually disposed under or above the heater 17, when the ventilating fan is operated, the air passing through the thermostat 16 and the heater 17 will form wind resistance, causing increased noise.

SUMMARY

Accordingly, it is desired to provide a ventilating fan for heating in which noise can be reduced.

In order to achieve the above object, the ventilating fan for heating according to the present disclosure comprises a main body frame provided with an opening, a fan casing provided with a fan therein, a heater assembly fixed at an air outlet of the fan casing and a thermostat for detecting an indoor temperature, the thermostat is embedded in an air-passageway wall.

A mounting portion of the thermostat and a base seat of a heater are integrally or separately formed.

The base seat of the heater has a side wall extending toward the inside of a main body and forming a part of an air-passageway side wall, and the thermostat is embedded in the side wall.

The ventilating fan for heating has the main body provided with a ventilating air-passageway in which the air from the air outlet is horizontally blown to outside of the main body and a circulating air-passageway in which the air from the air outlet is blown vertically downwardly to outside of the main body, the main body is provided therein with a damper provided at the air outlet of the fan and configured to switch the ventilating air-passageway and the circulating air-passageway and is also provided with the heater provided at the circulating air-passageway, and an air-passageway bottom wall below the fan is provided with a bottom portion inclined upwardly toward the air outlet, and the thermostat is provided on the side wall of the circulating air-passageway on an extension line of the bottom portion.

The ventilating fan for heating has the main body provided with a ventilating air-passageway in which the air from the air outlet is horizontally blown to outside of the main body and a circulating air-passageway in which the air from the air outlet is blown vertically downwardly to outside of the main body, the main body is provided therein with a damper provided at the air outlet of the fan and configured to switch the ventilating air-passageway and the circulating air-passageway and is also provided with the heater provided at the circulating air-passageway, and an air-passageway bottom wall below the fan is provided with a bottom portion inclined upwardly toward the air outlet, the base seat of the heater extends to the bottom portion and forms an extension portion constituting a part of the bottom portion, and the thermostat is provided on the extension portion.

The advantage of the present disclosure is that a thinned product can be realized while simplifying the whole structure and reducing the noise.

DETAILED DESCRIPTION

Figure 1A:
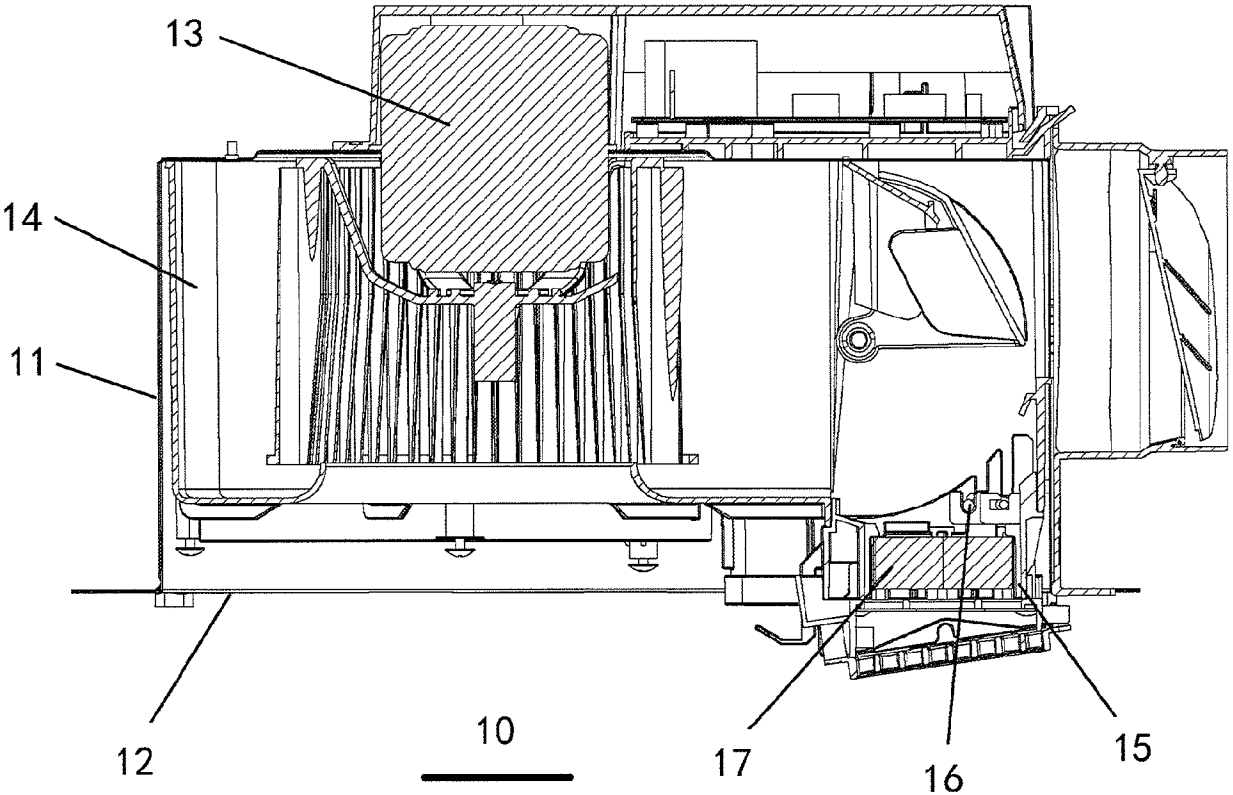
FIG. 1A is a cross-sectional view of the prior art.
Figure 1B:
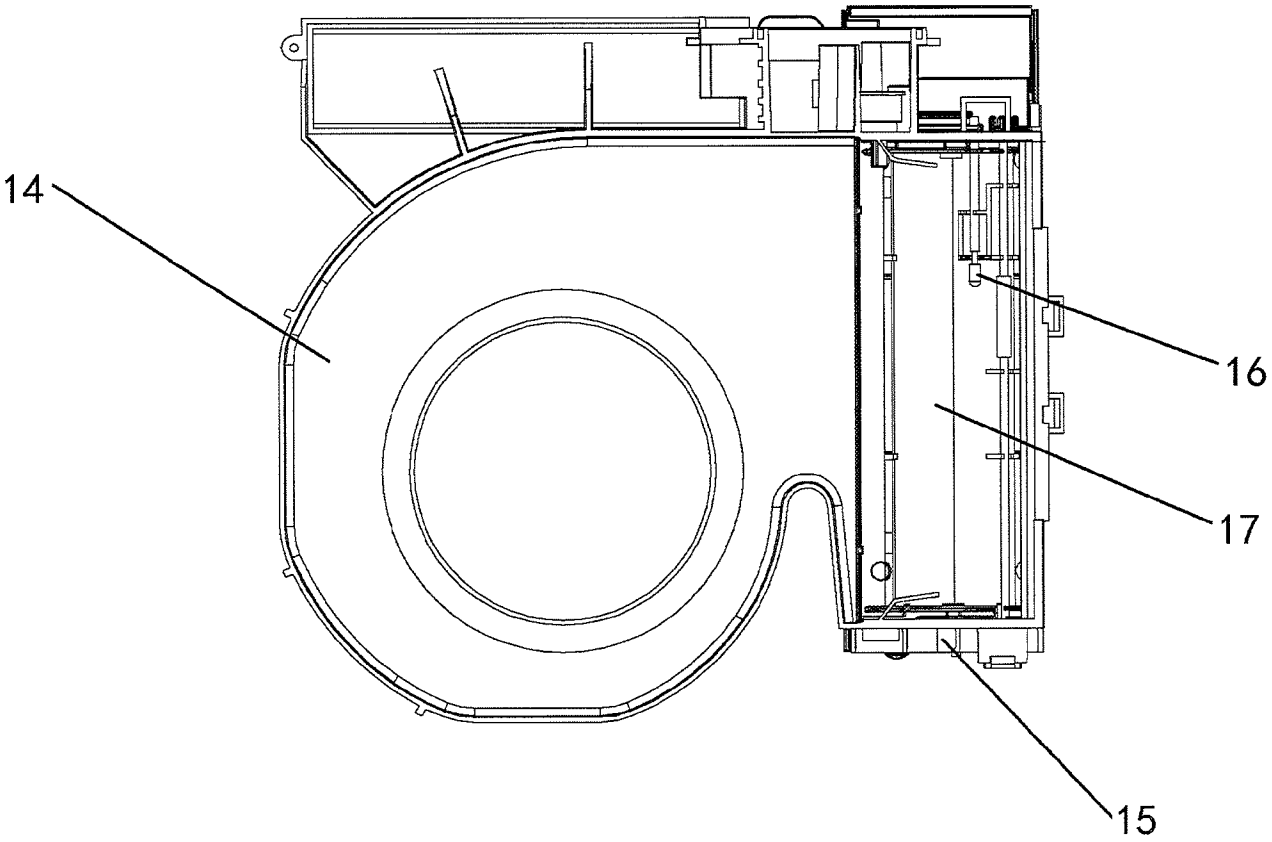
FIG. 1B is a top view of the prior art.
Figure 2:
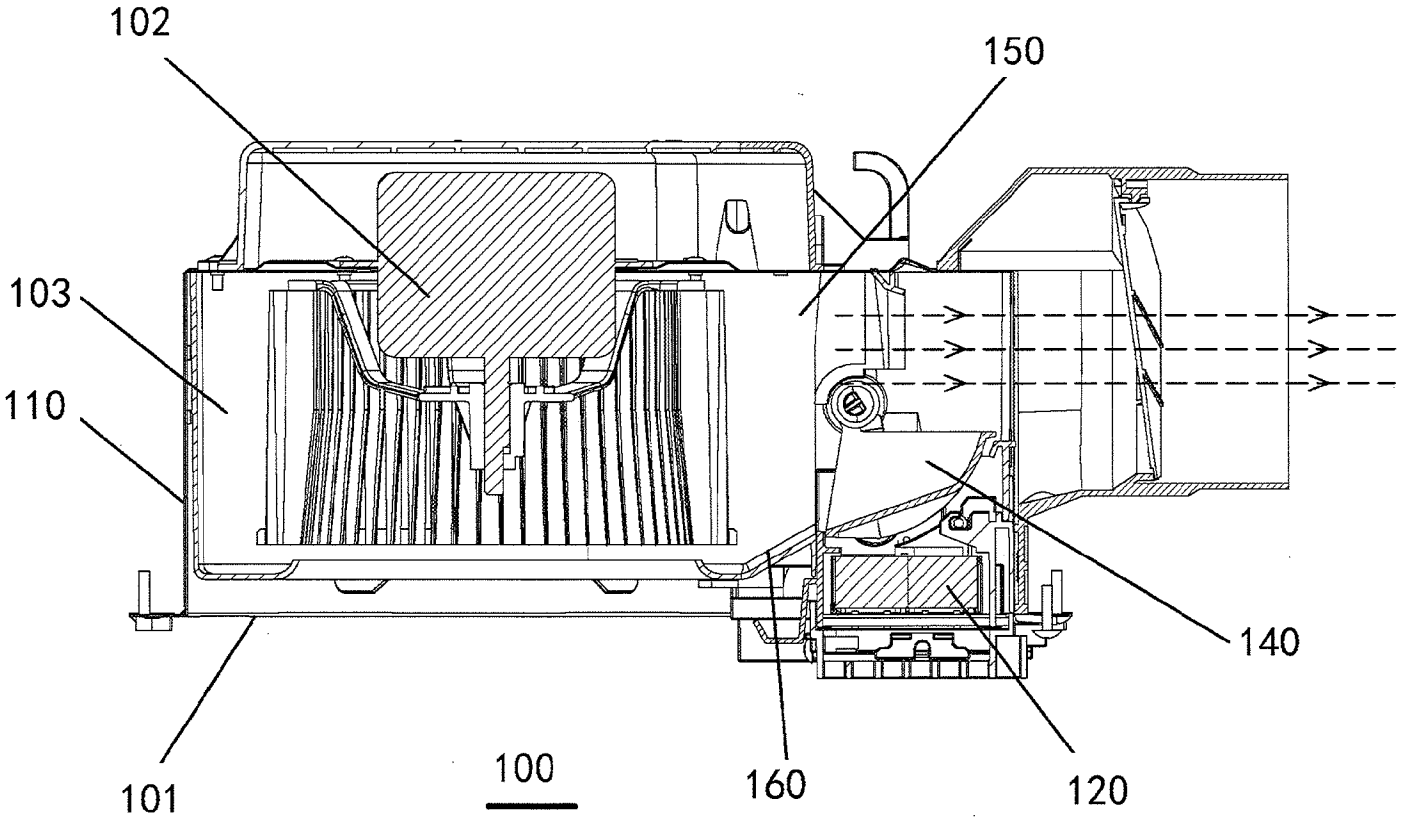
FIG. 2 is a schematic view of the ventilating fan, in a ventilating mode, according to a first embodiment of the present disclosure.
Figure 3:
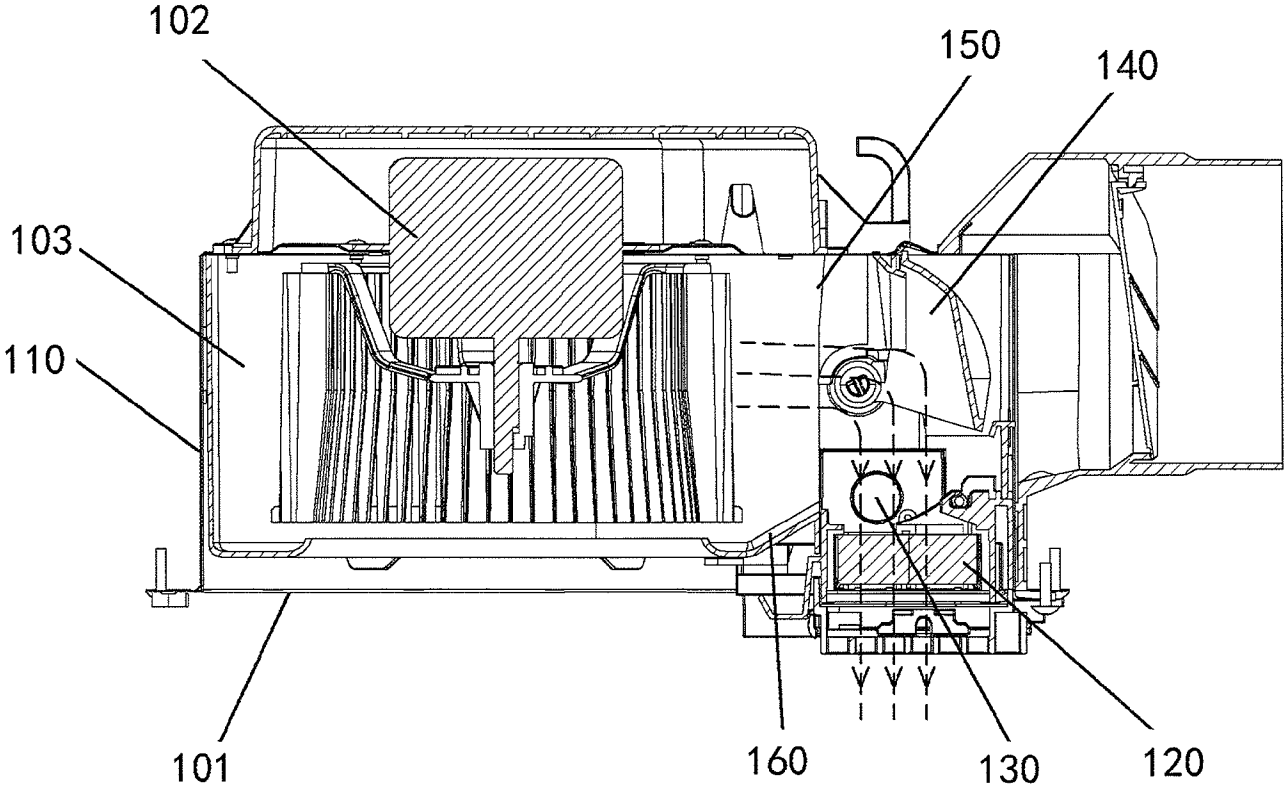
FIG. 3 is a schematic view of the ventilating fan, in a heating mode, according to the first embodiment of the present disclosure.
Figure 4:
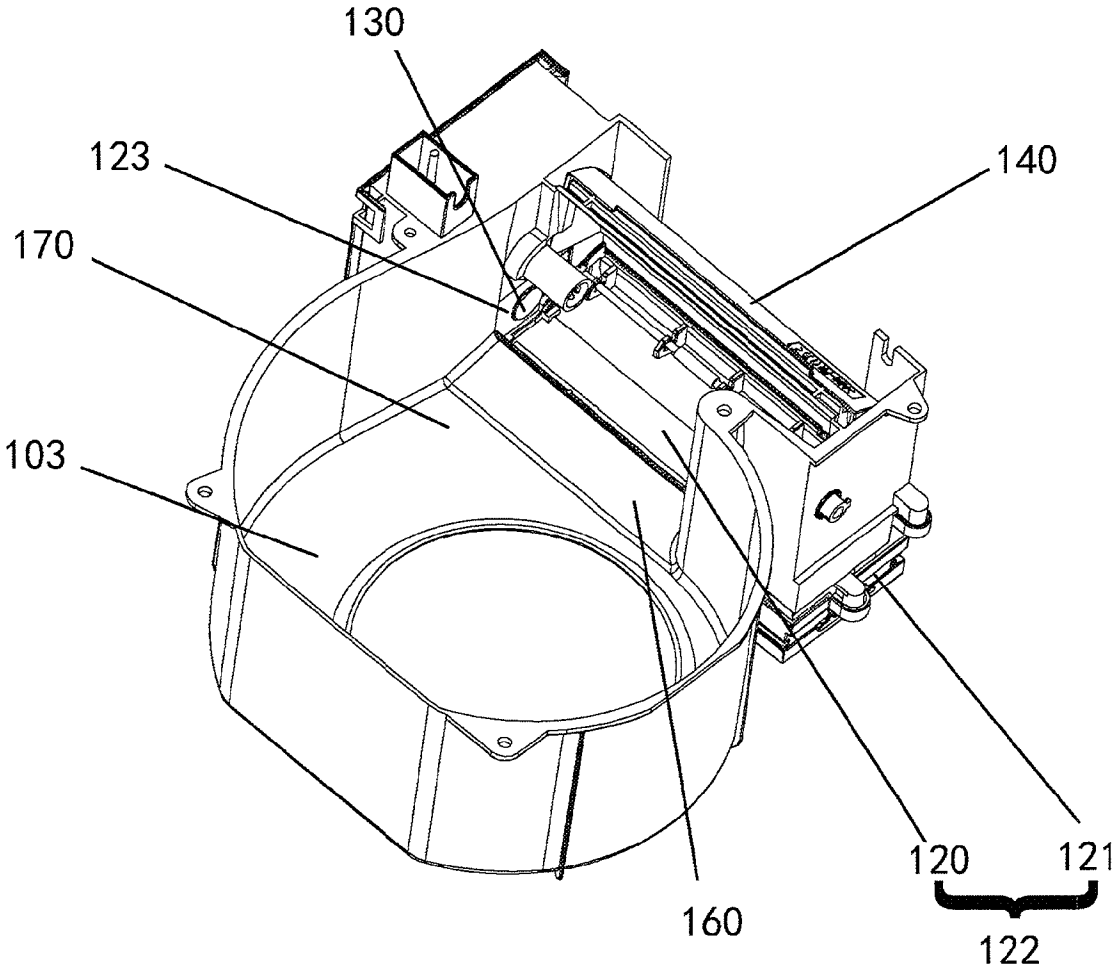
FIG. 4 is a schematic mounting view of the thermostat according to the first embodiment of the present disclosure.

FIG. 2 is a schematic view of the ventilating fan, in a ventilating mode, according to a first embodiment of the present disclosure, FIG. 3 is a schematic view of the ventilating fan, in a heating mode, according to the first embodiment of the present disclosure, and FIG. 4 is a schematic mounting view of the thermostat according to the first embodiment of the present disclosure.

As shown in FIGS. 2 and 3, the ventilating fan for heating 100 comprises a main body frame 110 provided with an opening 101, a fan casing 103 provided with a fan motor 102 therein, and a heater assembly 122 fixed at an air outlet of the fan casing 103. The ventilating fan for heating 100 has a main body provided with a ventilating air-passageway A in which the air from the air outlet 150 is horizontally blown to outside of the main body and a circulating air-passageway B in which the air from the air outlet 150 is blown vertically downwardly to outside of the main body. The main body is provided therein with a damper 140 provided at the air outlet 150 of the fan and configured to switch the above ventilating air-passageway A and the above circulating air-passageway B. The heater assembly 122 is also provided in the main body and is provided at the circulating air-passageway B. An air-passageway bottom wall 170 below the fan is provided with a bottom portion 160 inclined upwardly toward the air outlet 150. The thermostat 130 is provided on the air-passageway side wall of the circulating air-passageway B on the extension line of the bottom portion 160. The above air-passageway side wall and the air-passageway bottom wall 170 together form an air-passageway wall.

As shown in FIG. 4, the heater assembly 122 comprises a heater 120 and a base seat 121. The base seat 121 has a side wall 123 which is configured to extend toward the inside of the main body and forms a part of the air-passageway side wall. A mounting portion of the thermostat is formed on the side wall 123. The thermostat 130 is embedded in the side wall 123. Thus, the thermostat 130 can detect the temperature of the air blown toward the heater 120.

With the above structure, since the thermostat 130 is embedded in the air-passageway side wall, when the ventilating fan is operated for heating, the air passing through the heater 120 will not be against the thermostat 130 to form wind resistance. Thus, the noise can be suppressed.

Further, the thermostat 130 is provided near the heater 120. That is to say, the thermostat 130 is provided near the heater assembly 122.

Such a structure can more sensitively detect a change in the temperature of the air near the heater 120 and hence can detect malfunction of the fan or blockage of the air-passageway.

Further, even if the thermostat 130 is provided in a rotation region of the damper 140 which rotates to switch the heating mode and the ventilating mode, since the thermostat 130 will not interfere with the damper 140 or the like, a height of a space between the damper 140 and the heater 120 can be lessened compared to the conventional ventilating fan in which the thermostat is provided outside of the rotation region of the damper, so that the main body can be thinned.

As described above, the mounting portion of the thermostat 130 is integrally formed with the base seat 121 of the heater. Since the thermostat 130 and the heater 120 are high temperature members, those members directly contacting with the thermostat 130 and the heater 120 should be made of burning-resistant material. Since the mounting portion of the thermostat 130 is integrally formed with the base seat 121 of the heater, the thermostat 130 is received in the base seat 121 of the heater, and thus no additional mounting portion is needed for mounting the thermostat 130 and the whole structure is simplified. However, in the present disclosure, it is not necessary to integrally form the mounting portion of the thermostat 130 with the base seat 121 of the heater. According to different requirements, the mounting portion of the thermostat 130 and the base seat 121 of the heater may be separately provided.

Further, in consideration of material cost, the cost of the burning-resistant material is high. Since both of the mounting portion of the thermostat 130 and the base seat 121 of the heater need to be made of burning-resistant material, it is necessary to provide two mounting portions made of burning-resistant material if the mounting portion of the thermostat and the base seat of the heater are separately provided. Thus, the cost is increased and the structure becomes complicated. In this case, the arrangement of integrally forming the mounting portion of the thermostat 130 with the base seat 121 of the heater can simplify the whole structure and can reduce the cost while enhancing product performance.

Further, since the side wall 123 of the heater 120 forms a part of the air-passageway side wall, the wind from the fan can smoothly flow into the heater 120. The air flowing into the circulating air-passageway from the bottom portion 160, which is inclined upward from the air-passageway bottom wall 170 provided below the fan, concentratedly flows upward, and thus the air flow becomes denser. Furthermore, since the thermostat 130 is provided on the extension line of the bottom portion 160, the temperature of the flowing air can be more sensitively detected.

If the amount of air is reduced due to abnormity of the fan or the air-passageway, such as malfunction of the fan or blockage of the air-passageway, the thermostat 130 can more sensitively detect a change in a temperature of the air flowing toward the vicinity of the thermostat. The temperature detected by the thermostat 130 is greatly influenced by the heat transferred from the heater. Thus, the abnormity can be detected more sensitively.

Figure 5:
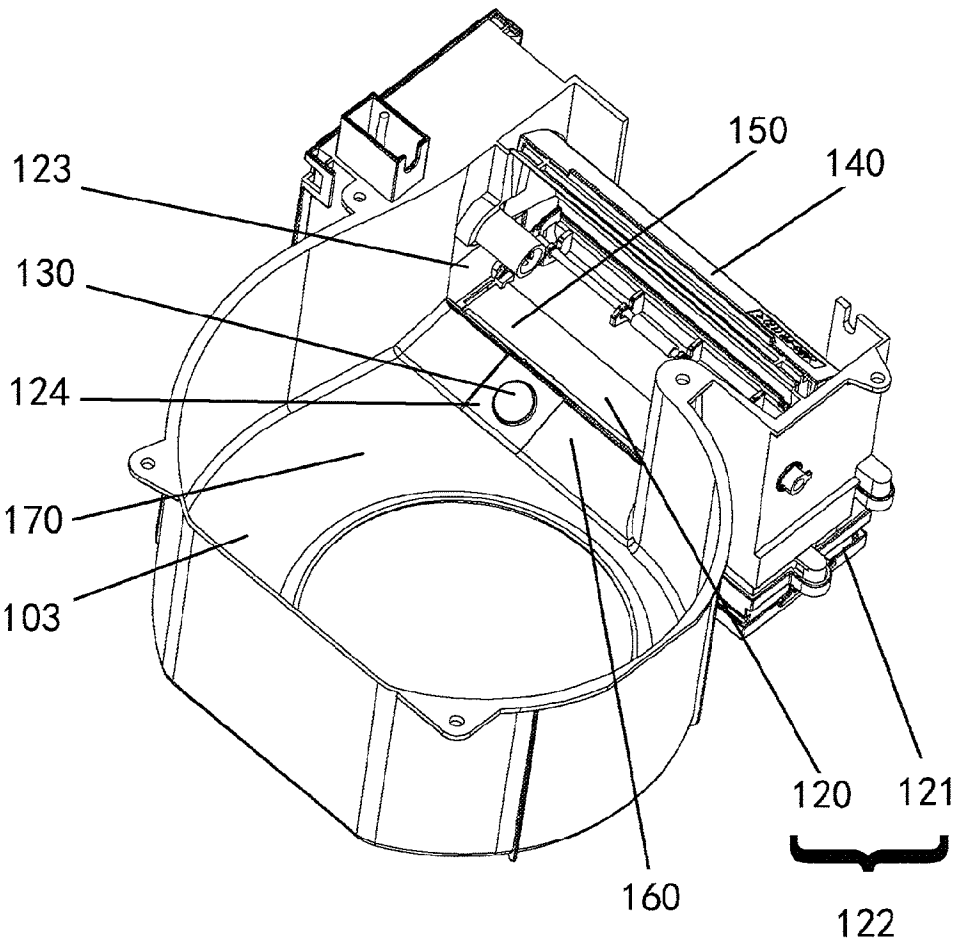
FIG. 5 is a schematic mounting view of the thermostat according to a second embodiment of the present disclosure.

FIG. 5 shows a schematic mounting view of the thermostat according to a second embodiment of the present disclosure. As shown in the Fig., the difference from the first embodiment is that the base seat 121 of the heater extends to the bottom portion 160 which is inclined upward from the air-passageway bottom wall 170 provided below the fan and forms an extension portion 124 constituting a part of the bottom portion 160. Similar to the first embodiment, the bottom portion 160 is inclined upward toward the air outlet 150, and the thermostat 130 is provided on the extension portion 124. Since the extension portion 124 is provided in the air-passageway, the thermostat 130 can detect the temperature of the flowing air and will also not interfere with rotation of the damper 140. Further, when the ventilating fan is operated for heating, the air to pass through the heater 120 will not be against the thermostat 130 to form wind resistance, and thus the noise can be suppressed.

What is claimed is:

1. A ventilating fan for heating, comprising:

a main body frame provided with an opening, a fan casing provided with a fan therein, a heater assembly fixed at an air outlet of the fan casing and a thermostat for detecting an indoor temperature, wherein the ventilating fan for heating has the main body provided with a ventilating air-passageway in which the air from the air outlet is horizontally blown to outside of the main body and a circulating air-passageway in which the air from the air outlet is blown vertically downwardly to outside of the main body, the main body is provided therein with a damper provided at the air outlet of the fan and configured to switch the ventilating air-passageway and the circulating air-passageway and is also provided with a heater provided at the circulating air-passageway, and an air-passageway bottom wall below the fan is provided with a bottom portion inclined upwardly toward the air outlet, and the thermostat is provided on a side wall of the circulating air-passageway on an extension line of the bottom portion.

2. The ventilating fan for heating according to claim 1, wherein a mounting portion of the thermostat and a base seat of a heater are integrally or separately formed.

3. The ventilating fan for heating according to claim 2, wherein a base seat of the heater has a side wall extending toward the inside of a main body and forming a part of an air-passageway side wall, and the thermostat is embedded in the side wall.

4. The ventilating fan for heating according to claim 1, wherein the thermostat is provided near the heater assembly.

5. A ventilating fan for heating, comprising:

a main body frame provided with an opening, a fan casing provided with a fan therein, a heater assembly fixed at an air outlet of the fan casing and a thermostat for detecting an indoor temperature, wherein a mounting portion of the thermostat and a base seat of a heater are integrally or separately formed, wherein the ventilating fan for heating has the main body provided with a ventilating air-passageway in which the air from the air outlet is horizontally blown to outside of the main body and a circulating air-passageway in which the air from the air outlet is blown vertically downwardly to outside of the main body, the main body is provided therein with a damper provided at the air outlet of the fan and configured to switch the ventilating air-passageway and the circulating air-passageway and is also provided with a heater provided at the circulating air-passageway, and an air-passageway bottom wall below the fan is provided with a bottom portion inclined upwardly toward the air outlet, the base seat of the heater extends to the bottom portion and forms an extension portion constituting a part of the bottom portion, and the thermostat is provided on the extension portion.

6. The ventilating fan for heating according to claim 5, wherein the thermostat is provided near the heater assembly.

* * * * *